US006767474B2

(12) United States Patent
Trueba et al.

(10) Patent No.: US 6,767,474 B2
(45) Date of Patent: Jul. 27, 2004

(54) FLUID EJECTOR HEAD HAVING A PLANAR PASSIVATION LAYER

(75) Inventors: Kenneth E Trueba, Philomath, OR (US); Ronnie J. Yenchik, Blodgett, OR (US); Ronald A. Hellekson, Eugene, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/198,904

(22) Filed: Jul. 19, 2002

(65) Prior Publication Data

US 2004/0012653 A1 Jan. 22, 2004

(51) Int. Cl.[7] ..... B41J 2/04
(52) U.S. Cl. ..... 216/27; 347/63; 347/64
(58) Field of Search ..... 216/27; 347/63, 347/64

(56) References Cited

U.S. PATENT DOCUMENTS

| | | | | |
|---|---|---|---|---|
| 4,734,563 A | | 3/1988 | Lloyd | |
| 6,137,443 A | | 10/2000 | Beatty et al. | |
| 6,153,114 A | | 11/2000 | Figuerdo et al. | |
| 6,183,067 B1 | * | 2/2001 | Matta | 347/65 |
| 6,267,905 B1 | * | 7/2001 | Silverbrook | 216/27 |
| 6,274,056 B1 | * | 8/2001 | Silverbrook | 216/27 |
| 6,372,609 B1 | | 4/2002 | Aga et al. | |
| 6,378,996 B1 | * | 4/2002 | Shimada et al. | 347/70 |
| 6,402,972 B1 | * | 6/2002 | Weber et al. | 216/27 |
| 2002/0075346 A1 | | 6/2002 | Xu et al. | |

OTHER PUBLICATIONS

USPTO application No. 10/003,780; Atty. Dockett No. 10960906–1; Filed Oct. 31, 2001 Applicant: Charles Haluzak, et al; Title: Fluid Ejection Device Fabrication 33pages.

'Research & Development' SiGen (Silicon Genesis Corp.) 3pages printed from the web url: http://www.sigen.com/reasearch.htm on Jul. 16, 2002.

* cited by examiner

*Primary Examiner*—Nadine G. Norton
*Assistant Examiner*—Shamim Ahmed
(74) *Attorney, Agent, or Firm*—Donald J. Coulman

(57) ABSTRACT

A fluid ejector head, includes a fluid definition layer defining a chamber, the fluid definition layer having a substantially planar passivation surface. In addition, the fluid ejector head includes a sacrificial material filling the chamber that is planarized to the plane formed by the passivation surface. Further, the fluid ejector head includes a passivation layer, having substantially planar opposed major surfaces, formed on the planar passivation surface; and a resistive layer having substantially planar opposed major surfaces in contact with the passivation layer.

26 Claims, 16 Drawing Sheets

FLUID EJECTOR HEAD HAVING A PLANAR PASSIVATION LAYER

BACKGROUND

Description of the Art

Fluid ejection cartridges typically include a fluid reservoir that is fluidically coupled to a substrate. The substrate normally contains an energy-generating element that generates the force necessary for ejecting the fluid through one or more nozzles. Two widely used energy-generating elements are thermal resistors and piezoelectric elements. The former rapidly heats a component in the fluid above its boiling point creating a bubble causing ejection of a drop of the fluid. The latter utilizes a voltage pulse to move a membrane that displaces the fluid resulting in ejection of a drop of the fluid.

Currently there is a wide variety of highly efficient inkjet printing systems in use. These systems are capable of dispensing ink in a rapid and accurate manner. However, there is also a demand by consumers for ever-increasing improvements in reliability and image quality, while providing systems at lower cost to the consumer. In an effort to reduce the cost and size of ink jet printers, and to reduce the cost per printed page, printers have been developed having small moving printheads that are typically connected to larger stationary ink supplies. This development is called "off-axis" printing, and has allowed the larger ink supplies, "ink cartridges," to be replaced as it is consumed without requiring the frequent replacement of the costly printhead, containing the fluid ejectors and nozzle system.

Improvements in image quality have typically led to an increase in the organic content of inkjet inks. This increase in organic content typically leads to inks exhibiting a more corrosive nature, potentially resulting in the degradation of the materials coming into contact with such inks. Degradation of these materials by more corrosive inks raises reliability and material compatibility issues. These material compatibility issues generally relate to all the materials the ink comes in contact with. However, they are exacerbated in the printhead because, in an off-axis system, the materials around the fluid ejectors and nozzles need to maintain their functionality over a longer period of time. This increased reliability is necessary to ensure continued proper functioning of the printhead, at least through several replacements of the ink cartridges. Thus, degradation of these materials can lead to potentially catastrophic failures of the printhead.

Improvements in image quality have also typically resulted in demand for printheads with fluid ejector heads capable of ejecting smaller fluid drops. Generally, this is accomplished by decreasing the size of the resistor as well as decreasing the size and thickness of the fluid chamber surrounding the resistor. In addition, the size and thickness of the orifice or bore, through which the fluid is ejected, is also typically reduced to eject smaller drops. A fluid ejector head is typically fabricated utilizing conventional semiconductor processing equipment. Typically, etching or removing a conductor material creating an area of higher resistance forms the thermal resistor. A dielectric passivation layer is then typically deposited over the conductors and the resistor to provide electrical isolation and environmental protection from degradation by the fluid located in the fluid chamber. As the resistors and chambers become smaller the ability to maintain thickness uniformity in the various layers, because of step coverage issues, becomes more difficult. All of these problems can impact the manufacture of lower cost, smaller, and more reliable printer cartridges and printing systems.

DESCRIPTION OF THE PREFERRED EMBODIMENTS

Figure 1:
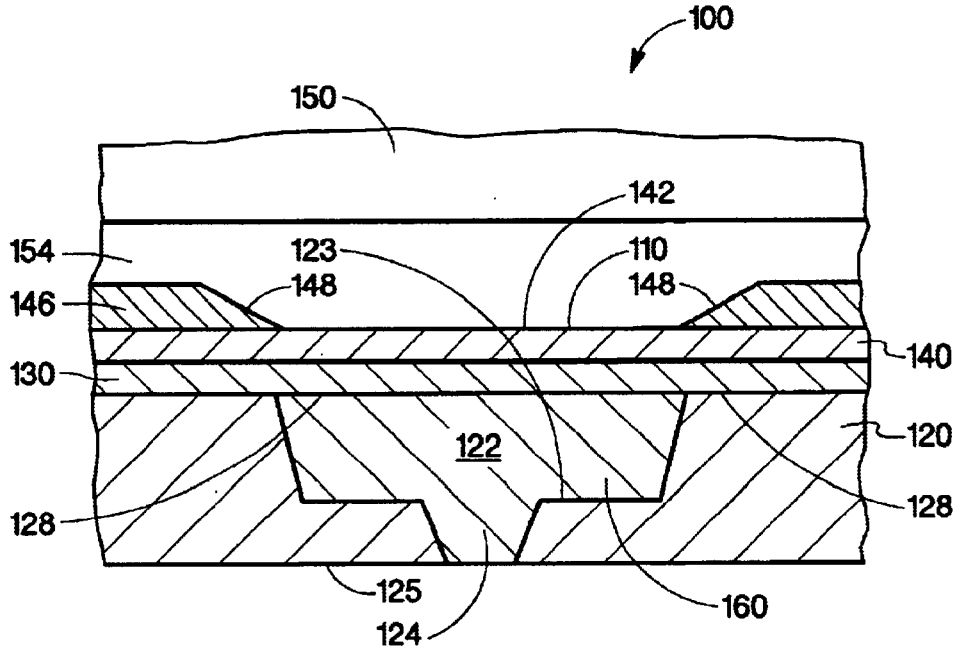
FIG. 1 is a cross-sectional view of a fluid ejector head according to an embodiment of the present invention.

Referring to FIG. 1, an embodiment of the present invention is shown in a simplified cross-sectional view. In this embodiment, fluid ejector head 100 includes passivation layer 130, having substantially planar opposed major surfaces. Passivation layer 130 provides environmental, mechanical, and electrical protection to resistor 142. Fluid definition layer 120 includes chamber 122 and bore 124, which extends from chamber surface 123 to exit surface 125. Chamber 122 and bore 124, in this embodiment, are filled with sacrificial material 160 which is planarized to form substantially planar passivation surface 128 on fluid definition layer 120. Passivation layer 130 is formed or deposited on passivation surface 128 formed on fluid definition layer 120 and sacrificial material 160. In this embodiment, fluid definition layer 120 is silicon, however, in alternate embodiments, metals, inorganic dielectrics, and various polymers may also be utilized. For example, fluid definition layer 120 may be an electrochemically formed metal orifice plate containing bore 124 and chamber 122. Another example of fluid definition layer 120 is a micro-molded plastic structure containing chamber 122 and bore 124. Still another example is a polymer layer, such as a polyimide film, containing chamber 122 and bore 123 formed by chemically etching or laser ablation.

Fluid definition layer 120, in this embodiment, has a thickness in the range from about 0.1 micrometers to about 10 micrometers. In alternate embodiments, fluid definition layer 120 may have a thickness in the range from about 0.25 micrometers to about 4.0 micrometers. Chamber 122, in this embodiment, has an area in the plane formed by chamber surface 123 in the range from about 0.5 square micrometers to about 10,000 square micrometers. In this embodiment bore 124 has an area in the plane formed by exit surface 125 that is less than the area of bore 124 in the plane formed by chamber surface 124.

It should be noted that the drawings are not true to scale. Certain dimensions have been exaggerated in relation to other dimensions in order to provide a clearer illustration and understanding of the present invention. In addition, for clarity not all lines are shown in each cross-sectional view. In addition, although some of the embodiments illustrated herein are shown in two-dimensional views with various regions having length and width, it should be understood that these regions are illustrations of only a portion of a device that is actually a three-dimensional structure. Accordingly, these regions will have three dimensions, including, length, width and depth, when fabricated on an actual device.

Passivation layer 130, in this embodiment, is a dielectric material, such as silicon carbide ($SiC_x$), silicon nitride ($Si_xN_y$), silicon oxide ($SiO_x$), boron nitride ($BN_x$), or a polyimide to name a few. In this embodiment, passivation layer 130 has a thickness in the range from about 5.0 nanometers to about 200 nanometers. In alternate embodiments, passivation layer 130 may have a thickness in the range from about 5.0 nanometers to about 75 nanometers.

Resistive layer 140, having substantially planar opposed major surfaces, is disposed over passivation layer 130 forming resistor 142. In this embodiment, fluid ejector actuator 110 is thermal resistor 142 that utilizes a voltage pulse to rapidly heat a component in a fluid above its boiling point creating a bubble causing ejection of a drop of the fluid. In alternate embodiments, other fluid ejector generators such as piezoelectric, ultrasonic, or electrostatic generators may also be utilized. Resistive layer 140, in this embodiment, has a thickness in the range from about 20 nanometers to about 400 nanometers. In alternate embodiments, resistive layer 140 may have a thickness in the range from about 50 nanometers to about 250 nanometers. Thermal resistor 142, in this embodiment, has an area in the range from about 0.05 square micrometers to about 2,500 square micrometers. In particular resistors having an area in the range from about 0.25 square micrometers to about 900 square micrometers may be utilized. Electrical conductors 146 including beveled edges 148 are disposed over resistive layer 140. Beveled edges 148 provide improved step coverage for substrate insulating layer 154. Electrical conductors 146 have a thickness in the range from about 50 nanometers to about 500 nanometers.

In this embodiment, substrate insulating layer 154 is a silicon oxide layer. However, in alternate embodiments, other materials may also be utilized, such as metals or polymers, depending on the particular substrate material used and the particular application in which fluid ejector head 100 will be used. Substrate insulating layer 154 has a thickness in the range from about 0.20 micrometers to about 2 micrometers. In particular thicknesses in the range from about 0.40 micrometers to about 0.75 micrometers can be utilized. In addition, fluid inlet channels (not shown) are formed in fluid ejector head 100 to provide a fluid path between a reservoir (not shown) and fluid ejector actuator 110. In this embodiment, substrate 150 is a silicon wafer having a thickness of about 300–700 micrometers. In alternative embodiments, other materials may also be utilized for substrate 150, such as, various glasses, aluminum oxide, polyimide substrates, silicon carbide, and gallium arsenide. Accordingly, the present invention is not intended to be limited to those fluid ejector heads fabricated in silicon semiconductor materials.

Sacrificial layer 160 is removed by a selective etch that is selective to sacrificial material 160 and etches fluid definition layer 120, substrate insulating layer 154, and passivation layer 130 at a slower rate if at all. Fluid ejector head 100 described in the present invention can reproducibly and reliably eject drops in the range of from about one femtoliter to about ten nanoliters depending on the parameters and structures of the fluid ejector head such as the size and geometry of the chamber around the fluid ejector, the size and geometry of the fluid ejector, and the size and geometry of the nozzle. When fluid ejector actuator 110 is activated the fluid ejector head ejects essentially a drop of a fluid. Depending on the fluid being ejected as well as the parameters and structures of the fluid ejector what are commonly referred to as a tail and smaller satellite drops may be formed during the ejection process and are included in volume ejected.

Figure 2:
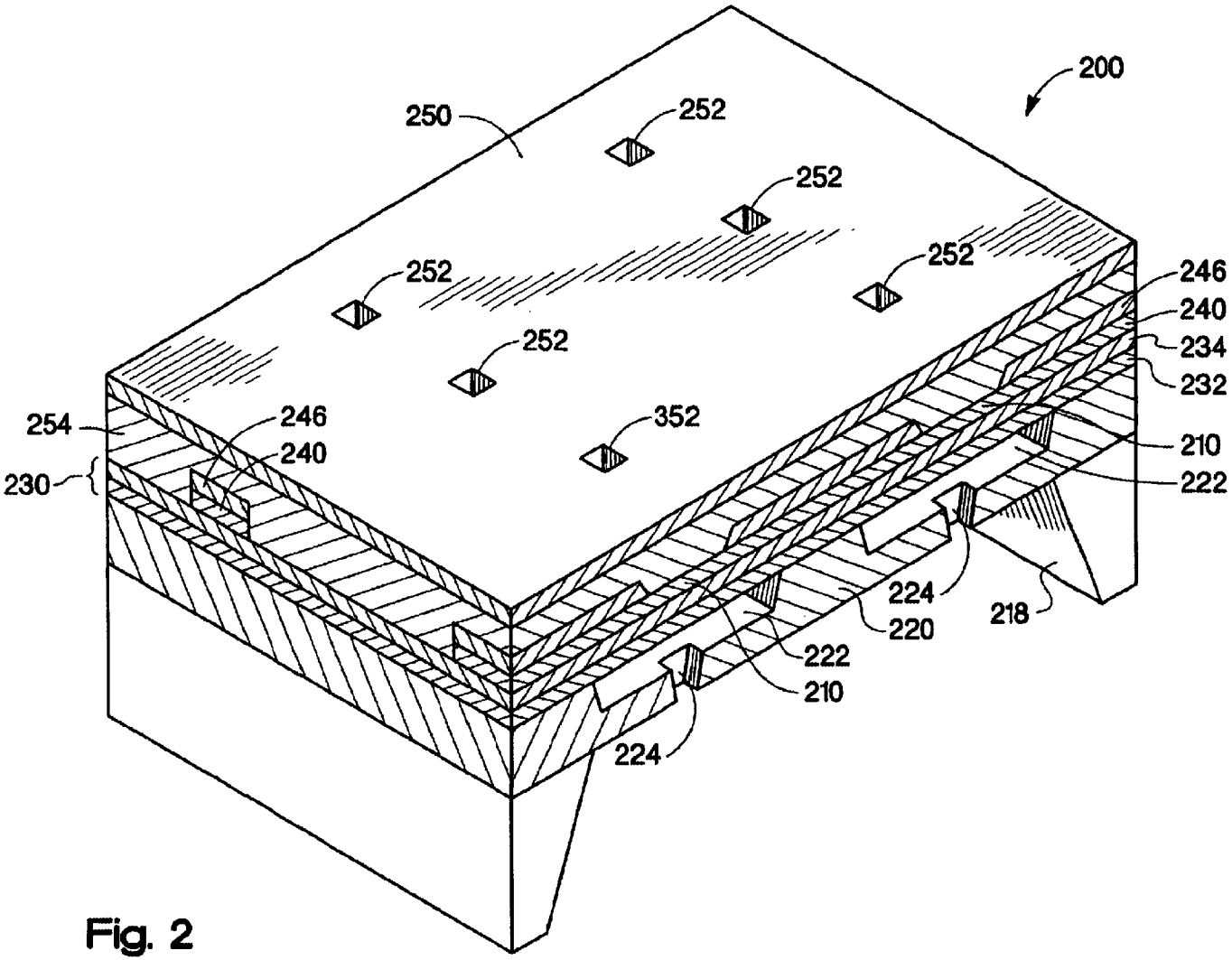
FIG. 2 is a cross-sectional isometric view of a fluid ejector head according to an alternate embodiment of the present invention.

An alternate embodiment is shown in a cross-sectional isometric view in FIG. 2. In this embodiment, fluid definition layer 220 is a thick silicon oxide layer formed on bore support or support 218, which is a silicon wafer. In alternate embodiments, fluid definition layer 220 and support 218 may be formed for example from metals, inorganic dielectrics, polymers and combinations thereof. Chamber 222 and bore 224 are formed in fluid definition layer 220. However, in alternate embodiments, chamber 222 may be formed in a layer distinct from the layer that forms bore 224. For example, bore 224 may be formed in an electroformed metal layer with chamber 222 formed in an epoxy layer coated on the electroformed metal layer. Another example would be forming bore 224 in a polyimide film and then forming chamber 222 in a silicon dioxide or metal layer deposited on the polyimide film. In addition, alternate embodiments, may have multiple bores formed in fluid definition layer 220 over chamber 222.

Passivation layer 230 includes first dielectric layer 232 and second dielectric layer 234. In this embodiment, first dielectric layer 232 is silicon carbide and second dielectric layer 234 is silicon nitride. However, in alternate embodiments, other inorganic dielectric or polymeric materials may also be utilized for first and second dielectric layers, as for example silicon oxide or polyimides. Resistive layer 240, resistor 242, electrical conductors 246, and substrate insulating layer 254 are similar to that described above and shown in FIG. 1. Substrate 250 in this embodiment is a metal layer that provides environmental protection as well as thermal dissipation of heat generated when fluid ejector actuators 210 are activated. Fluid inlet channels 252 are formed in fluid ejector head 200 to provide a fluid path between a reservoir (not shown) and fluid ejector actuator 210.

Figure 3A:
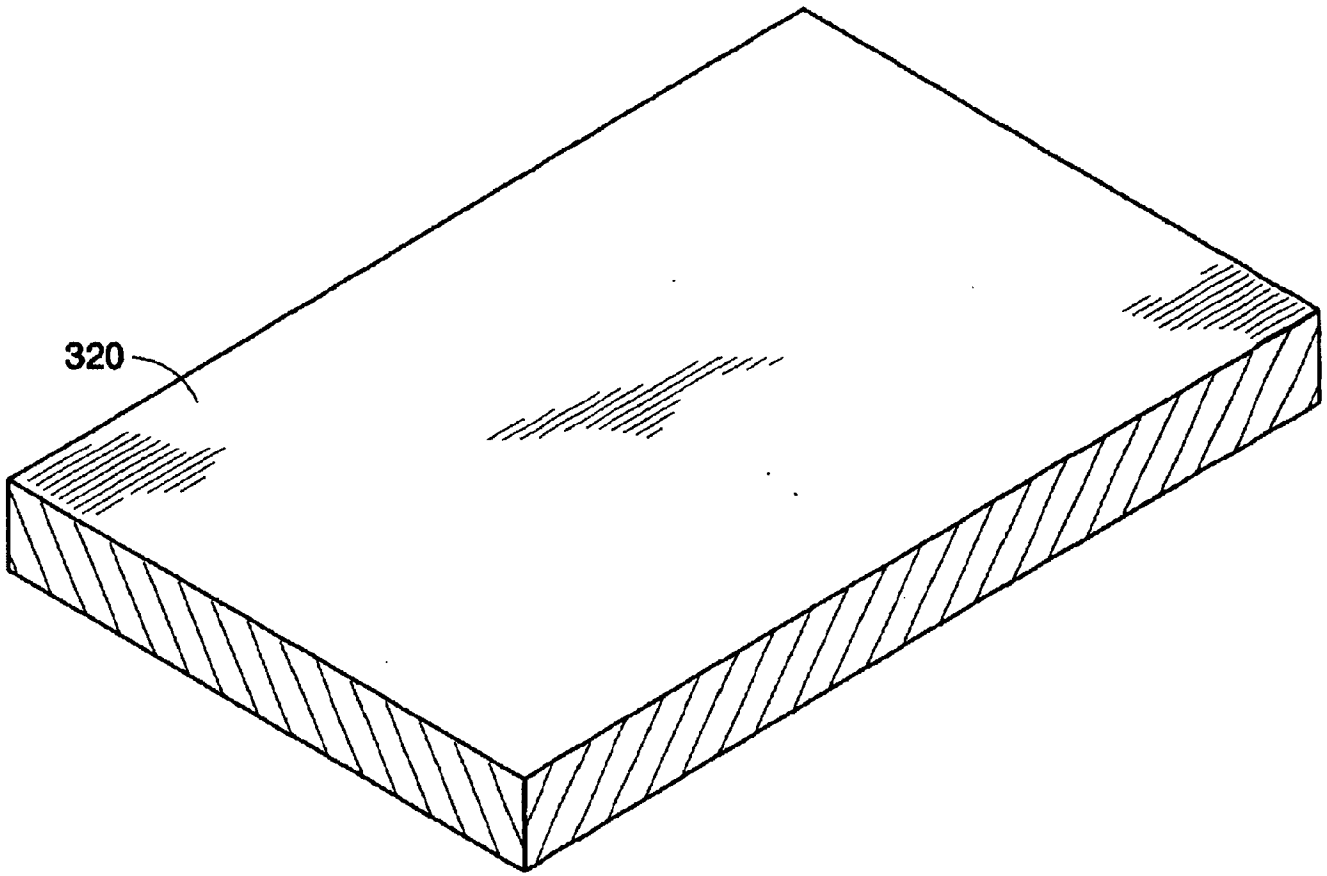
FIG. 3*a* is a cross-sectional isometric view of a fluid definition layer of a fluid ejector head according to an embodiment of the present invention.
Figure 3B:
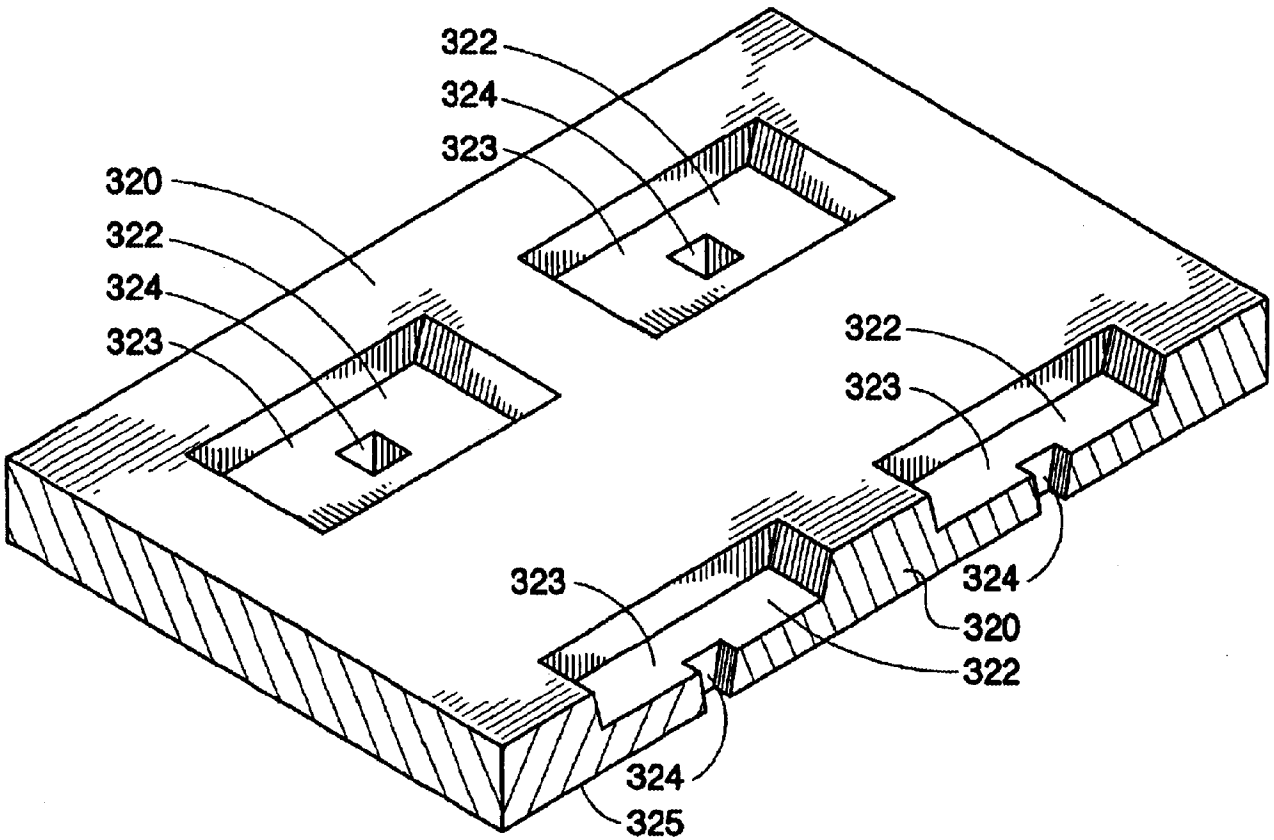
FIG. 3*b* is a cross-sectional isometric view of the fluid definition layer of a fluid ejector head seen in FIG. 3*a* after further processing according to an embodiment of the present invention.

Referring to FIGS. 3*a*–3*h* cross-sectional isometric views of a method of manufacturing a fluid ejector head according to an embodiment of the present invention is shown. FIG. 3*a* shows fluid definition layer 320, which depending on the particular material utilized may have a support layer (See FIG. 2), which will be described in greater detail later. FIG. 3*b* shows chambers 322 and bores 324 formed in fluid definition layer 320, where bores 324 extend from chamber surface 323 to exit surface 325. The process of forming chamber 322 and bore 324 depends on the particular material chosen to form fluid definition layer 320. The particular material chosen will depend on parameters such as the fluid being ejected, the expected lifetime of the fluid ejector head, the dimensions of the chamber and fluidic feed channels among others. In addition, separate chamber and bore or orifice layers may also be utilized which may be formed from different materials. Generally, conventional photoresist and photolithography processing equipment are used or conventional circuit board processing equipment is utilized. In this embodiment fluid definition layer 320 is a single crystal silicon layer.

Chambers 322 and bores 324 are formed by masking fluid definition layer 320 with the appropriate mask and removing the material in the chambers and bores via either a wet or dry etch chemistry. For example a dry etch may be used when vertical or orthogonal sidewalls are desired. Another example is the use of a wet etch such as tetra methyl ammonium hydroxide (TMAH) when sloping sidewalls are desired. In addition, combinations of wet and dry etch may also be utilized when more complex structures are utilized for the chamber and bore. Other processes such as laser ablation, reactive ion etching, ion milling including focused ion beam patterning may also be utilized to form chambers 322 and bores 324. Other materials such as silicon oxide or silicon nitride may also be utilized, using deposition tools such as sputtering or chemical vapor deposition and photolithography tools for patterning. Micromolding, electroforming, punching, or chemical milling are all examples of techniques that may also be utilized depending on the particular materials utilized for fluid definition layer 320.

As noted above different materials may also be utilized to form an orifice or bore layer and a chamber layer. The chamber layer defines the sidewalls of the chamber and the orifice layer defines the bore and forms the top of the chamber. For example, the processes used to form a photoimagable polyimide orifice layer would be spin coating the polyimide on a bore support layer such as a silicon or metal wafer, followed by soft baking, expose, develop, and subsequently a final bake process. A chamber layer can then be formed utilizing the same or a similar polyimide as that used to form the bore. The chamber layer may also be formed utilizing a different material such as photoimagable epoxy. Another example would be utilizing what is generally referred to as a solder mask, to form either the chamber or bore, or both. Typically a solder mask utilizes a lamination process to adhere the material to a bore support layer, and the remaining steps would be those typically utilized in photolithography. A further example would be to form the bore layer by electroforming techniques and then spin coat or laminate a chamber layer material on the bore layer. In addition to utilizing different materials for the bore layer and chamber layer, different techniques for creating the bore and chamber may also be utilized such as laser ablation to form the nozzle and photolithographically forming the chamber.

Figure 3C:
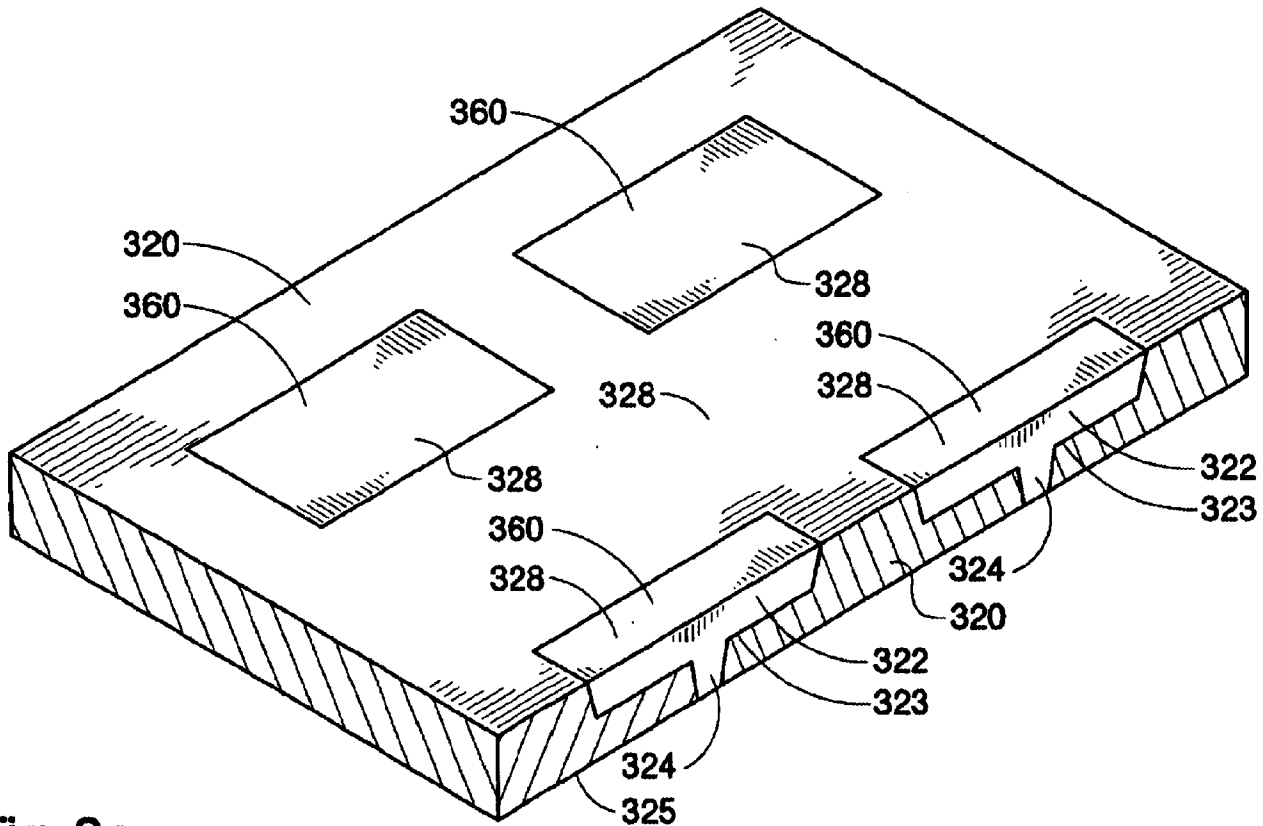
FIG. 3*c* is a cross-sectional isometric view of the fluid ejector head seen in FIG. 3*b* after further processing according to an embodiment of the present invention.

FIG. 3*c* shows planarized sacrificial layer or "lost wax" 360 suitably filling chambers 322 and bores 324. In this embodiment, sacrificial layer is a phosphorus doped spin on glass (SOG) spin coated onto fluid definition layer 320 after chambers 322 and bores 324 have been formed. Sacrificial material 360 is planarized, for example, by mechanical, resist etch-back, or chemical-mechanical processes, to form substantially planar passivation surface 328. Sacrificial material 360 may be any material that is differentially etchable to the surrounding structures such as the chamber and bore.

Figure 3D:
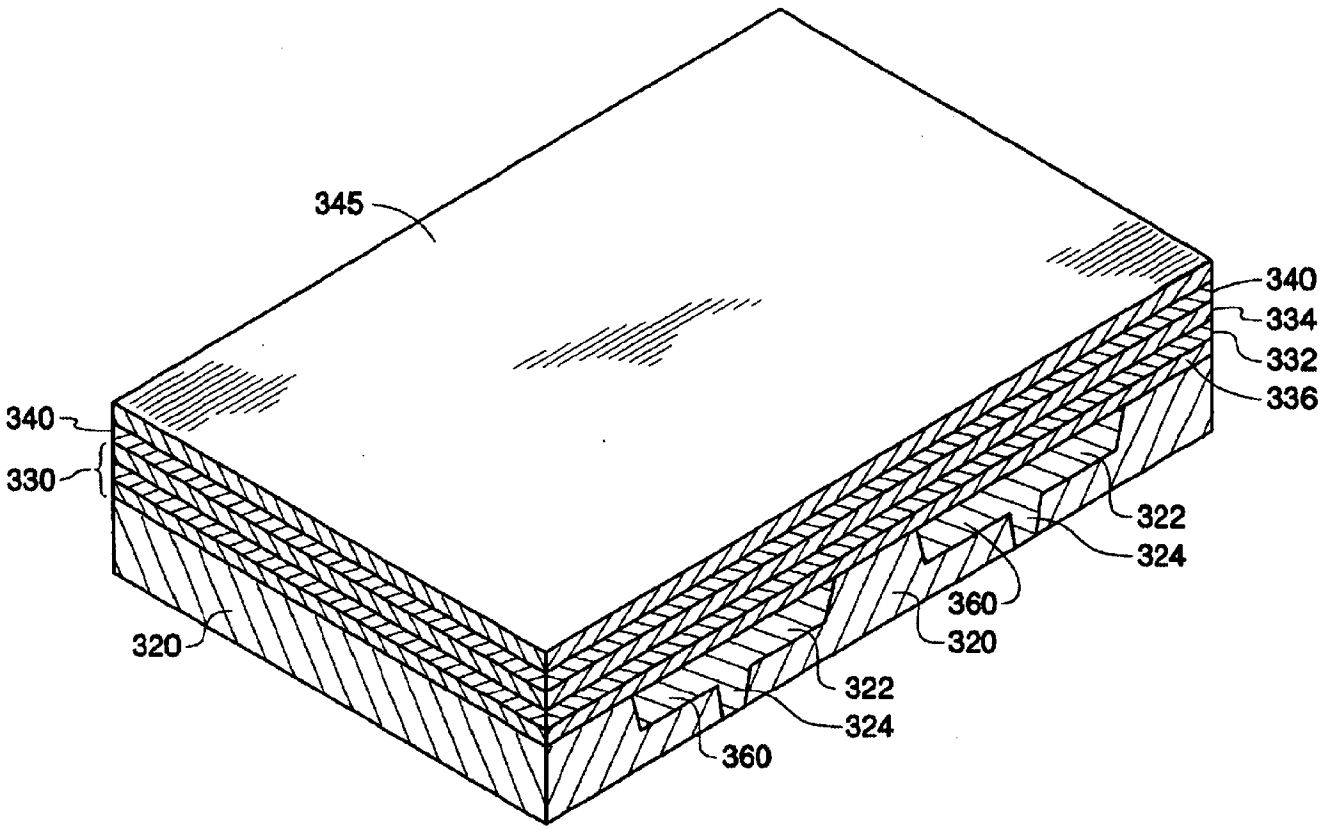
FIG. 3*d* is a cross-sectional isometric view of the fluid ejector head seen in FIG. 3*c* after further processing according to an embodiment of the present invention.

Passivation layer 330, resistive layer 340 and electrically conductive layer 345 are all formed over passivation surface 328 as shown in FIG. 3*d*. In this embodiment, passivation layer 330 includes cavitation layer 336, first dielectric layer 332 and second dielectric layer 334. Cavitation layer 336, in this embodiment, is a tantalum layer, however, in other embodiments cavitation layer may be any inorganic or organic material that has the appropriate environmental, crack and fatigue resistant properties, depending on the particular application in which the fluid ejector head will be used. First dielectric layer 332 and second dielectric layer 334, in this embodiment, are a silicon carbide layer, and a silicon nitride layer respectively. Depending on the particular application in which the fluid ejector head will be utilized any inorganic dielectric may be utilized. The particular material chosen will depend on parameters such as the fluid being ejected, the expected lifetime of the fluid ejector head, the dimensions of the chamber and fluidic feed channels among others. In this embodiment, cavitation layer 336, first dielectric layer 332, and second dielectric layer 334 have a thickness in the range from about 2.5 nanometers to about 200 nanometers.

Resistive layer 340, in this embodiment, is a tantalum aluminum alloy. In alternate embodiments, resistor alloys such as tungsten silicon nitride, or polysilicon may also be utilized. In other alternative embodiments, fluid drop actuators other than thermal resistors, such as piezoelectric, or ultrasonic may also be utilized. Electrically conductive layer 345, in this embodiment, is an aluminum copper silicon alloy. In other alternative embodiments, other interconnect materials commonly used in integrated circuit or printed circuit board technologies, such as other aluminum alloys, gold, or copper, may be utilized to form electrically conductive layer 345.

The process of creating passivation layer 330, resistive 340, and electrically conductive layer 345 utilizes conventional semiconductor processing equipment, such as sputter deposition systems, or chemical vapor deposition (CVD) systems for forming the layers. However, other techniques such as electron beam or thermal evaporation, plasma enhanced CVD, electroplating, or electroless deposition, may also be utilized separately or in combination with sputter deposition or CVD to form the layers depending on the particular materials utilized.

Figure 3E:
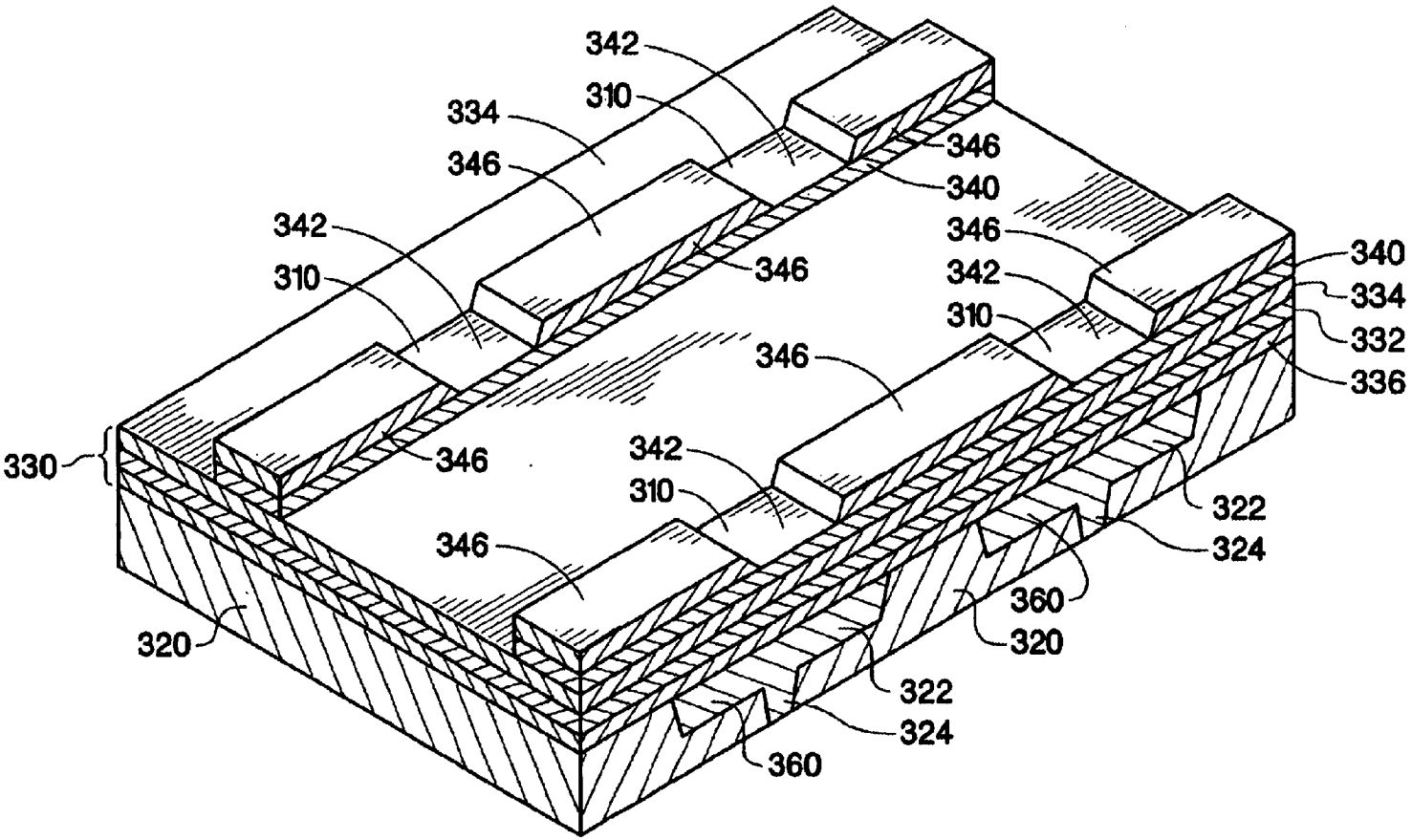
FIG. 3*e* is a cross-sectional isometric view of the fluid ejector head seen in FIG. 3*d* after further processing according to an embodiment of the present invention.
Figure 3F:
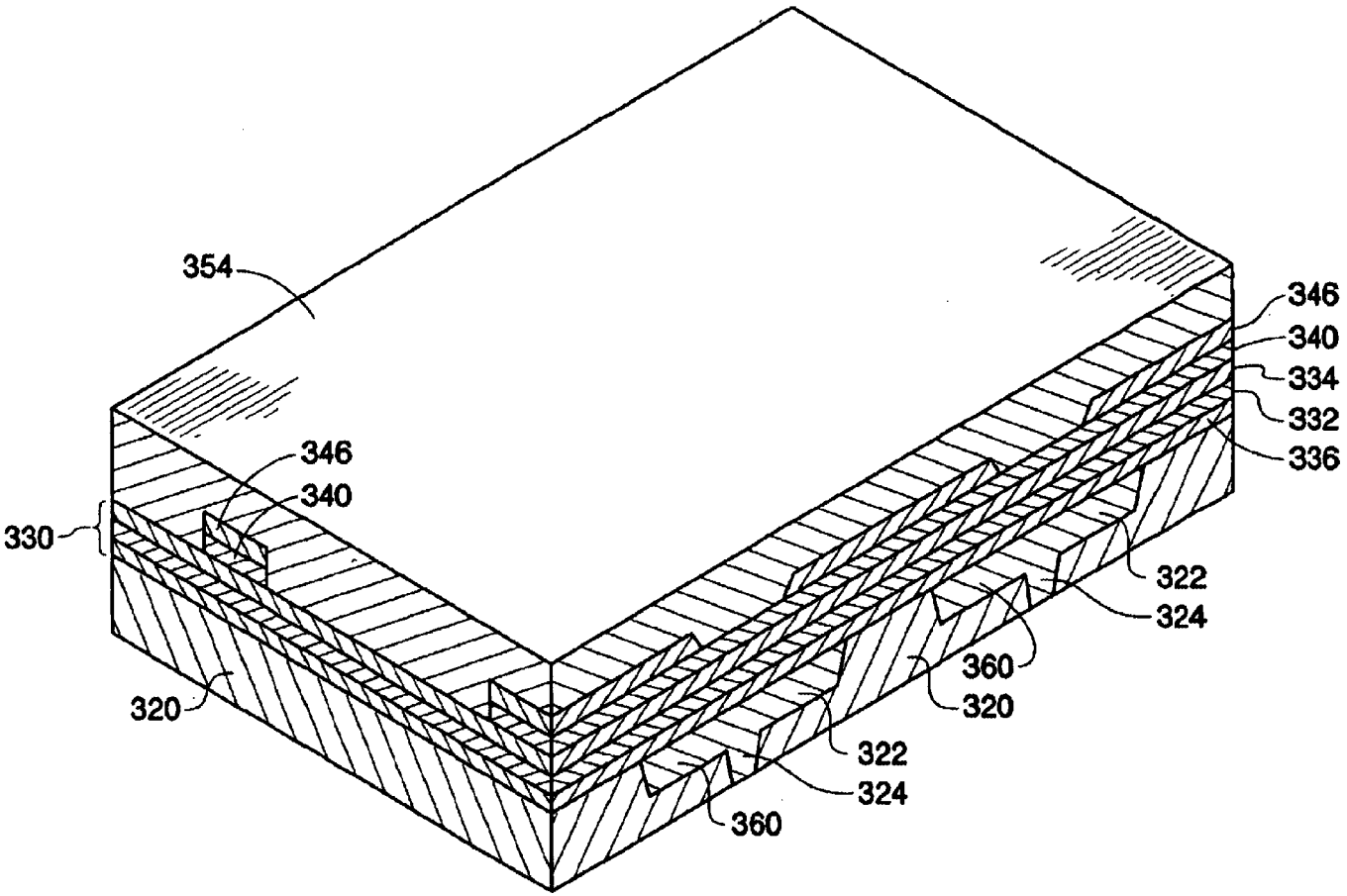
FIG. 3*f* is a cross-sectional isometric view of the fluid ejector head seen in FIG. 3*e* after further processing according to an embodiment of the present invention.

Resistors 342 and electrical conductors 346 are formed utilizing conventional semiconductor or printed circuit board processing equipment. In this embodiment, what is generally referred to as a subtractive process is used for defining or etching the location and shape of resistors 342 and electrical conductors or traces 346 as shown in FIG. 3*e*. Although a subtractive process is shown an additive process, where material is selectively deposited rather than removed, may also be utilized to form resistors 342 and electrical traces 346. Generally a slope metal etch may also be utilized in forming electrical conductors 346 to provide better step coverage for depositing or forming substrate insulating layer 354 as shown in FIG. 3*f*. Substrate insulating layer 354 serves to electrically isolate electrical conductors 346 and resistors 342 when an electrically conductive substrate such as silicon or a metal is utilized. In addition substrate insulating layer 354 also provides mechanical and environmental protection of resistors 342. In this embodiment, substrate insulating layer 354 is silicon oxide, in particular it is a silicon dioxide. However, depending on the particular materials utilized in the other layers such as fluid definition layer 320, first and second dielectric layers 332, and 334, various inorganic and polymeric dielectric materials also may be utilized.

Figure 3G:
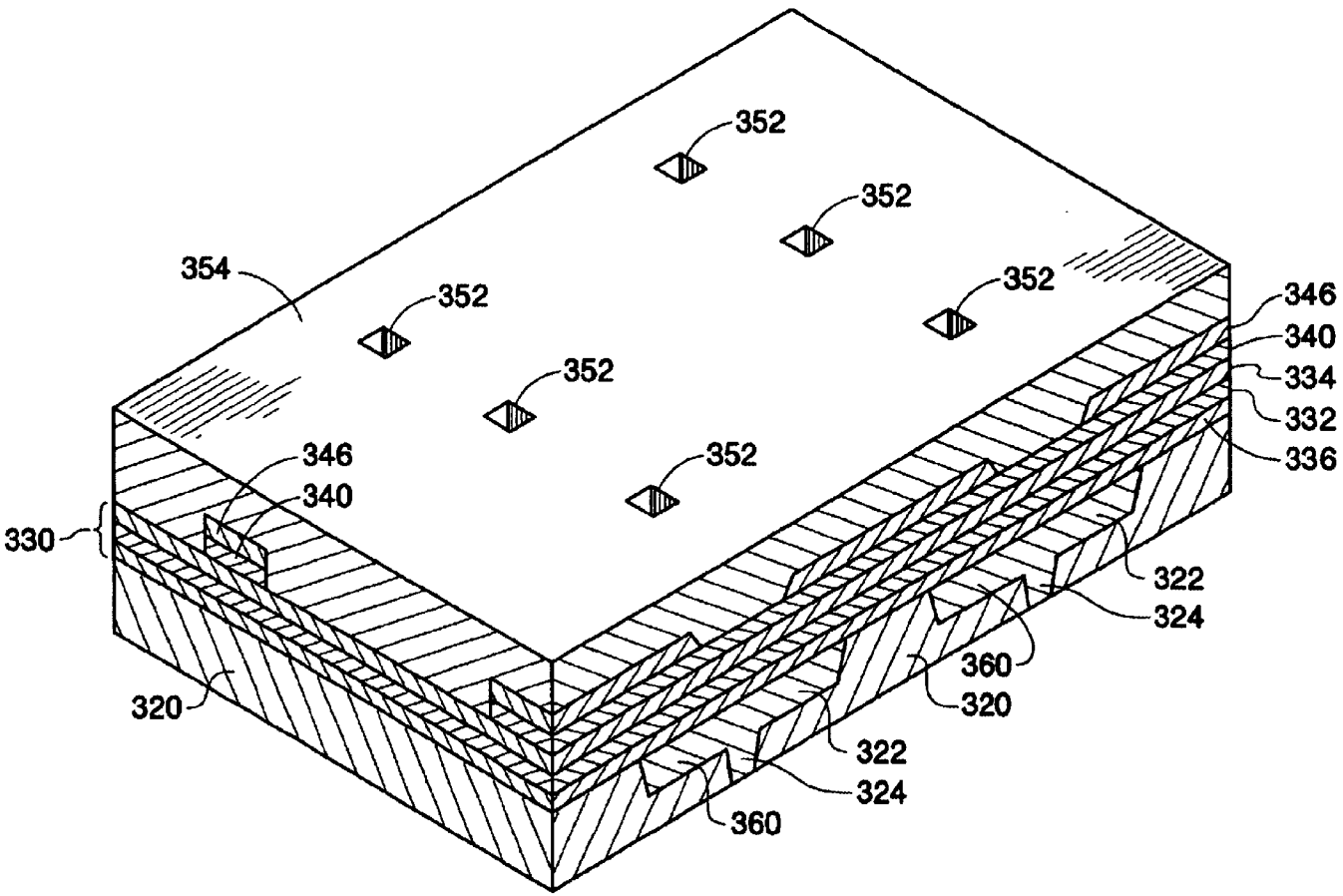
FIG. 3*g* is a cross-sectional isometric view of the fluid ejector head seen in FIG. 3*f* after further processing according to an embodiment of the present invention.

Fluid inlet channels 352 providing fluidic coupling of a reservoir (not shown) to chamber 322 is shown in FIG. 3*g*. In this embodiment fluid inlet channels are formed in substrate insulating layer 354, conductive layer 346, resistive layer 340, and passivation layer 330. In an alternate embodiment, fluid inlet channels are formed in substrate insulating layer 354 and first and second dielectric layers 332 and 334. The particular layers in which fluid inlet channels are formed in depends on parameters such as the fluid being ejected, the expected lifetime of the fluid ejector head, the dimensions of the chamber and fluidic feed channels among others.

Figure 3H:
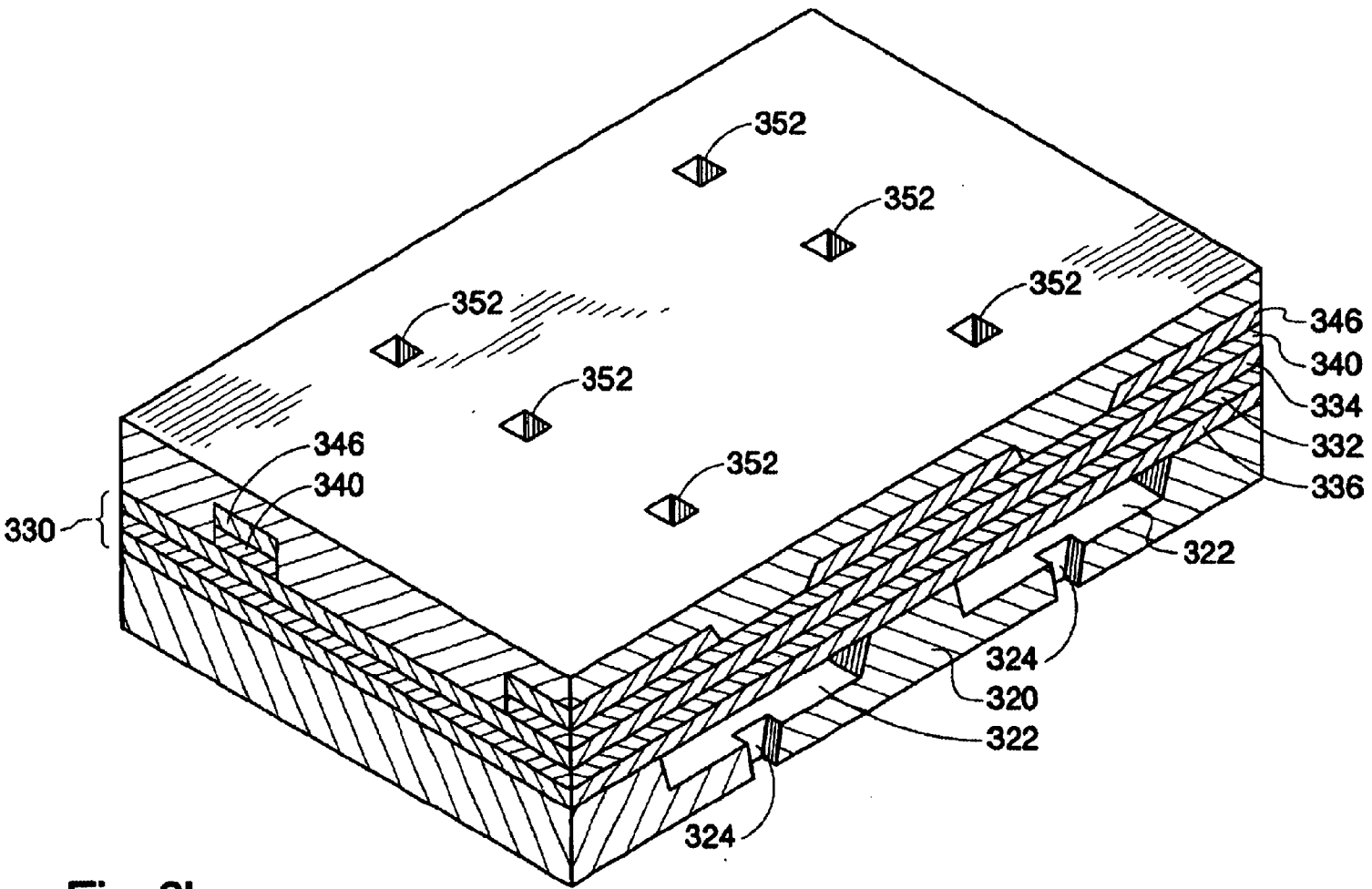
FIG. 3*h* is a cross-sectional isometric view of the fluid ejector head seen in FIG. 3*g* after further processing according to an embodiment of the present invention.

FIG. 3*h* illustrates the result of the removal of the "lost wax" or sacrificial material 360, seen in FIGS. 3*c*. FIG. 3*h* shows chambers 322 and bores 324 as voids with passivation layer 330, having substantially planar opposed major surfaces, forming the bottom of chambers 322. Sacrificial material 360 is removed by a selective etch that is selective to sacrificial material 360 and etches fluid definition layer 320, substrate insulating layer 354, and passivation layer 330 at a slower rate if at all. An etchant for this purpose, for phsophorus doped SOG, can be a buffered oxide etch that is essentially hydrofluoric acid and ammonium chloride. For an aluminum sacrificial material sulfuric peroxide or sodium hydroxide can be utilized.

Figure 4A:
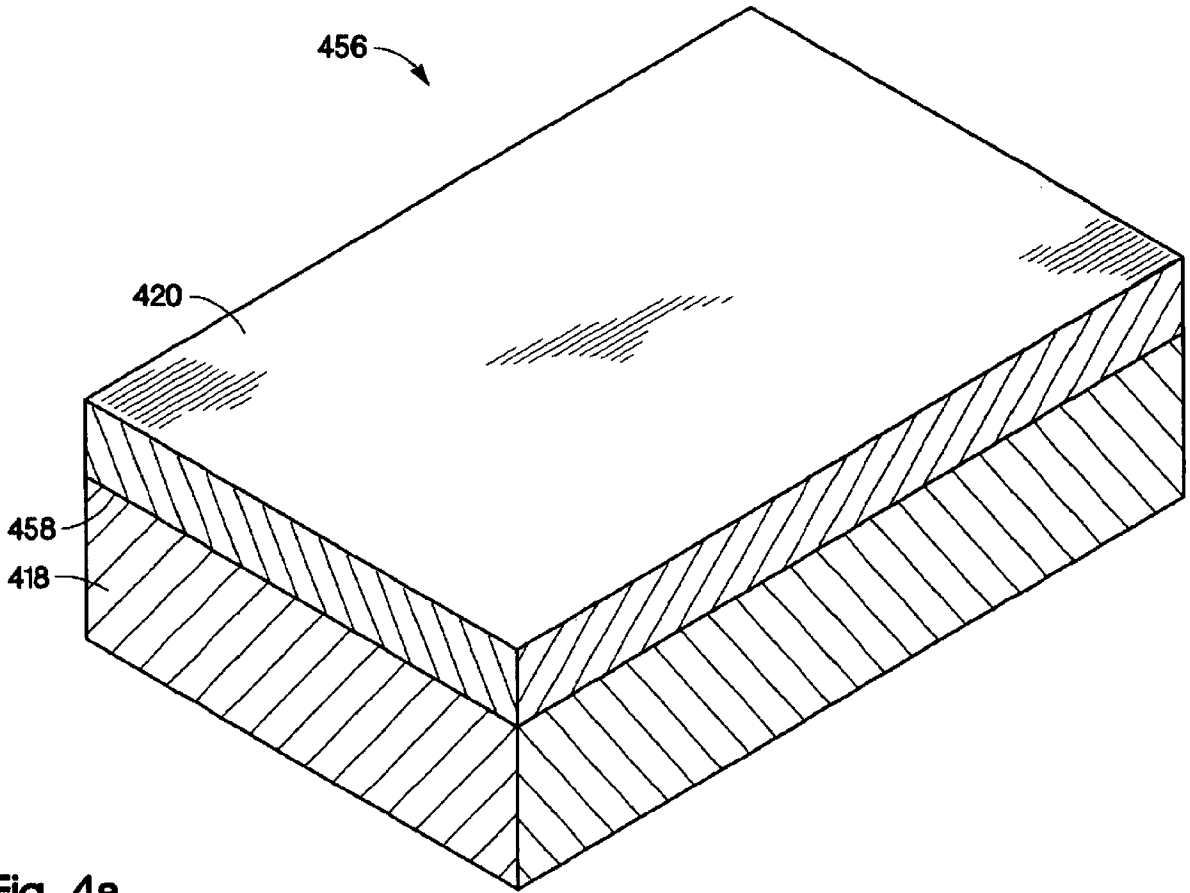
FIG. 4*a* is a is a cross-sectional isometric view of a silicon wafer according to an embodiment of the present invention.
Figure 4B:
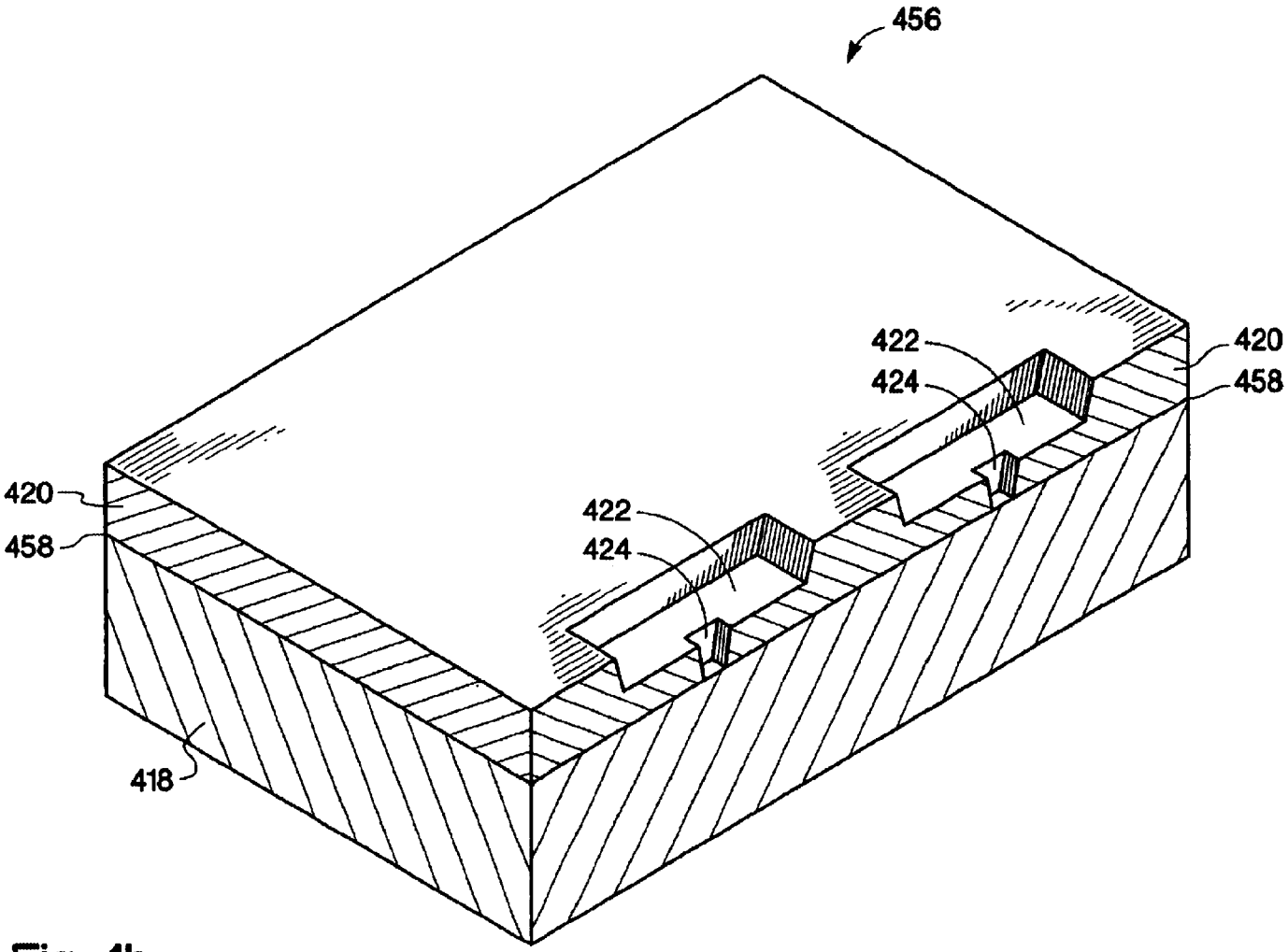
FIG. 4*b* is a cross-sectional isometric view of a silicon fluid definition layer of a fluid ejector head seen in FIG. 4*a* after further processing according to an embodiment of the present invention.

Referring to FIGS. 4*a*–4*d* cross-sectional isometric views of an alternate method of manufacturing a fluid ejector head according to an embodiment of the present invention is shown. FIG. 4*a* shows silicon wafer 456 including fluid definition layer 420 formed in silicon wafer 456 utilizing ion implantation. In particular hydrogen ion implantation may be used. In this embodiment, fluid definition layer 420 is a crystalline silicon layer. The ion implantation process produces separation interface 458. In this embodiment, separation interface 458 is an implanted region that provides a cleavable surface or interface to separate fluid definition layer 420 from bore support 418. In alternate embodiments, separation interface 458 may be formed by creating a sacrificial layer between fluid definition layer 420 and support 418. In those embodiments that utilize a sacrificial layer for separation interface 458, fluid definition layer 420 is separated from support 418 by utilizing a selective etch similar to that described above for the sacrificial material utilized in the chambers and bores. FIG. 4*b* shows chambers 422 and bores 424 formed in fluid definition layer 420. The process of forming chamber 422 and bore 424 will depend on parameters such as the fluid being ejected, the expected lifetime of the fluid ejector head, the dimensions of the chamber and fluidic feed channels among others. Processes similar to those described above may be utilized.

Figure 4C:
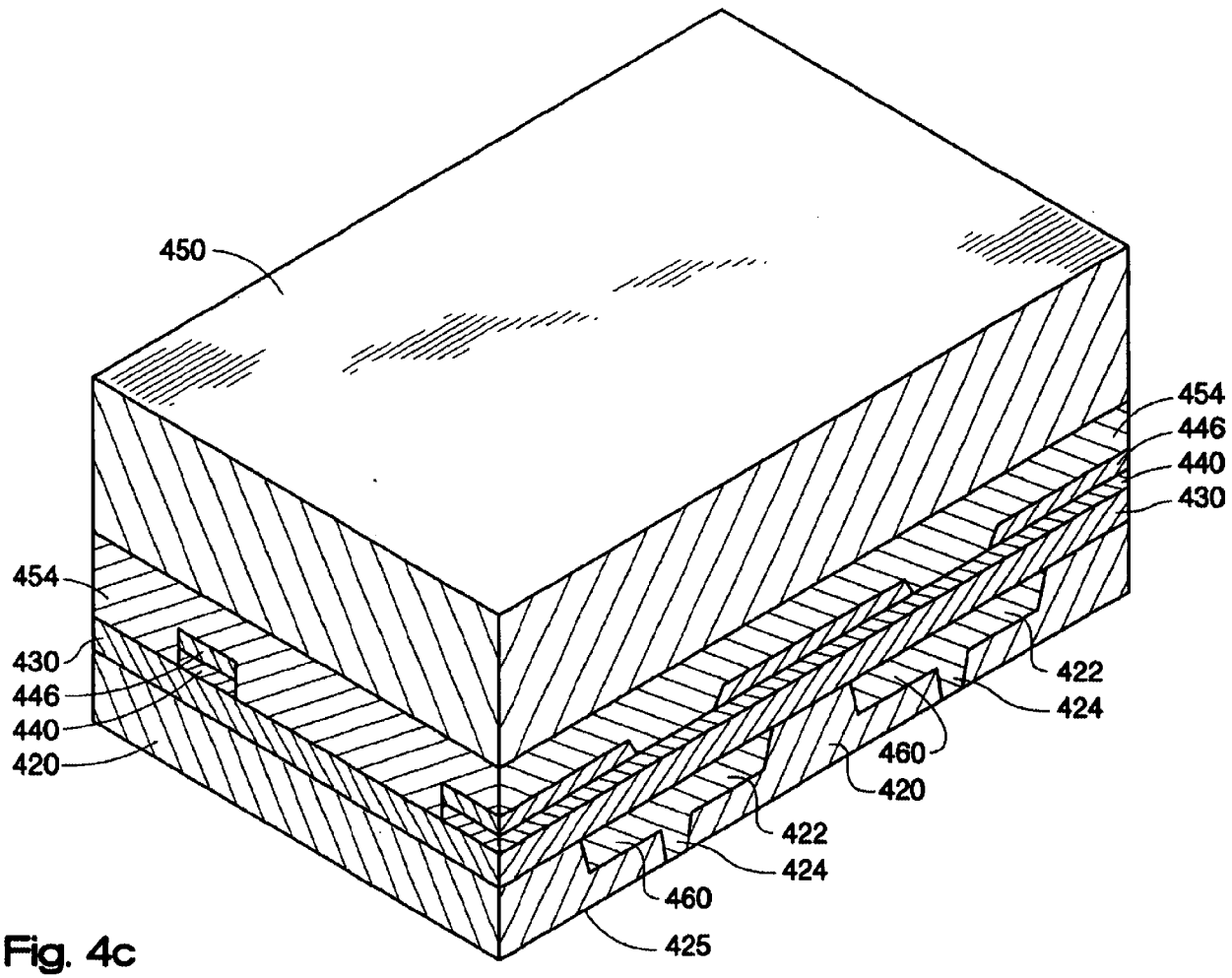
FIG. 4*c* is a cross-sectional isometric view of the fluid ejector head seen in FIG. 4*b* after further processing according to an embodiment of the present invention.
Figure 4D:
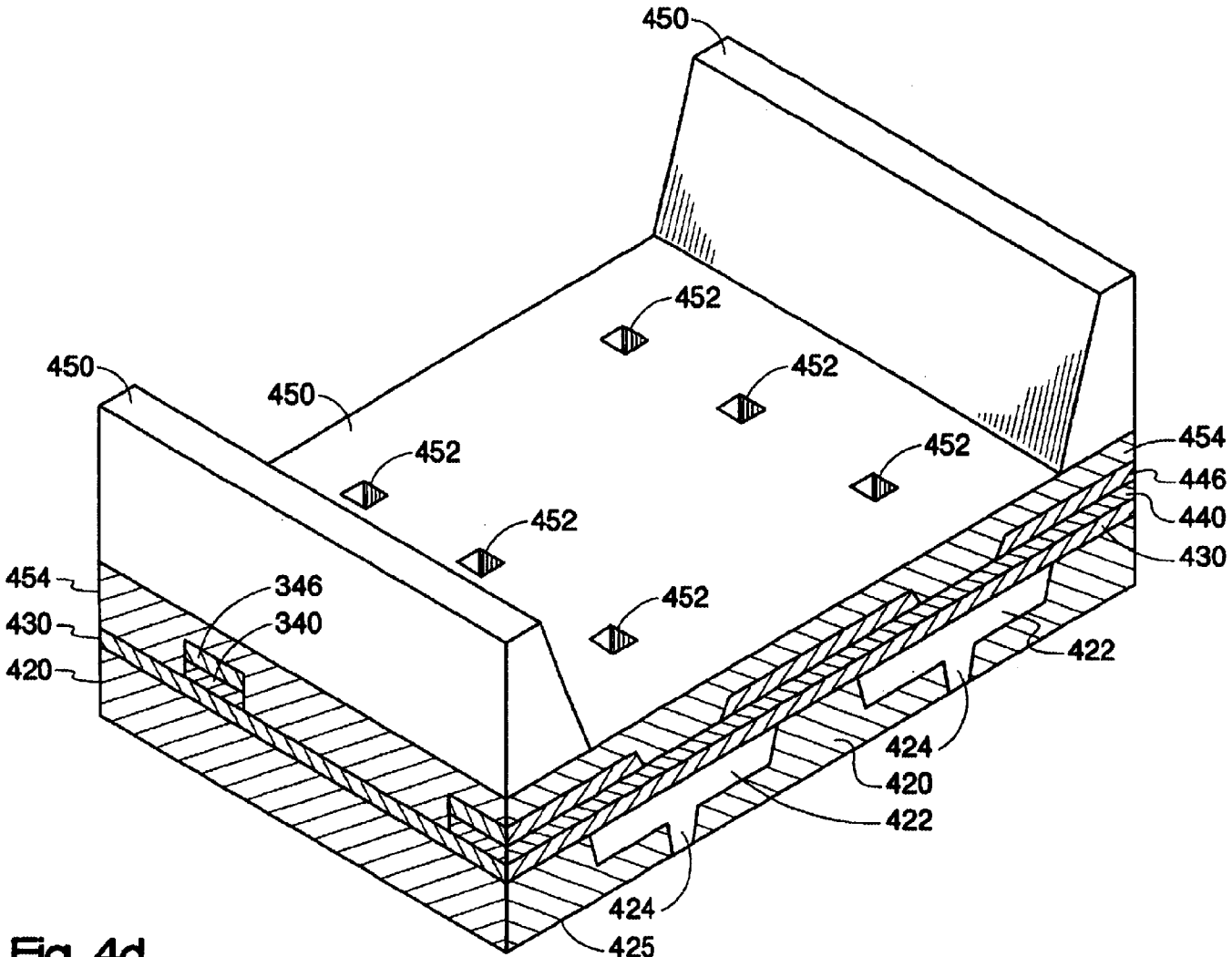
FIG. 4*d* is a cross-sectional isometric view of the fluid ejector head seen in FIG. 4*c* after further processing according to an embodiment of the present invention.

FIG. 4*c* shows the various layers such as protective layer 430, sacrificial layer 460, resistive layer 440 and conductive layer 446 formed on fluid definition layer 420 as previously described above. In this embodiment, substrate 450 is a silicon wafer bonded to substrate insulating layer 454, a silicon oxide layer, utilizing conventional bonding processes such as for example anodic bonding or fusion bonding. Exit surface 425 is formed by cleaving silicon wafer 456 at separation interface 458. In other embodiments exit surface 425 may be formed, for example, by mechanical grinding or polishing, chemical etching, or dissolution of a sacrificial layer to name a few processes. FIG. 4*d* illustrates the result of the removal of sacrificial layer 460 seen in FIG. 4*c*. Chambers 422 and bores 424 are shown as voids with passivation layer 430, having substantially planar opposed major surfaces, forming the bottom of chambers 422. Silicon substrate 450 is etched to provide access to fluid inlet channels 452.

Figure 5:
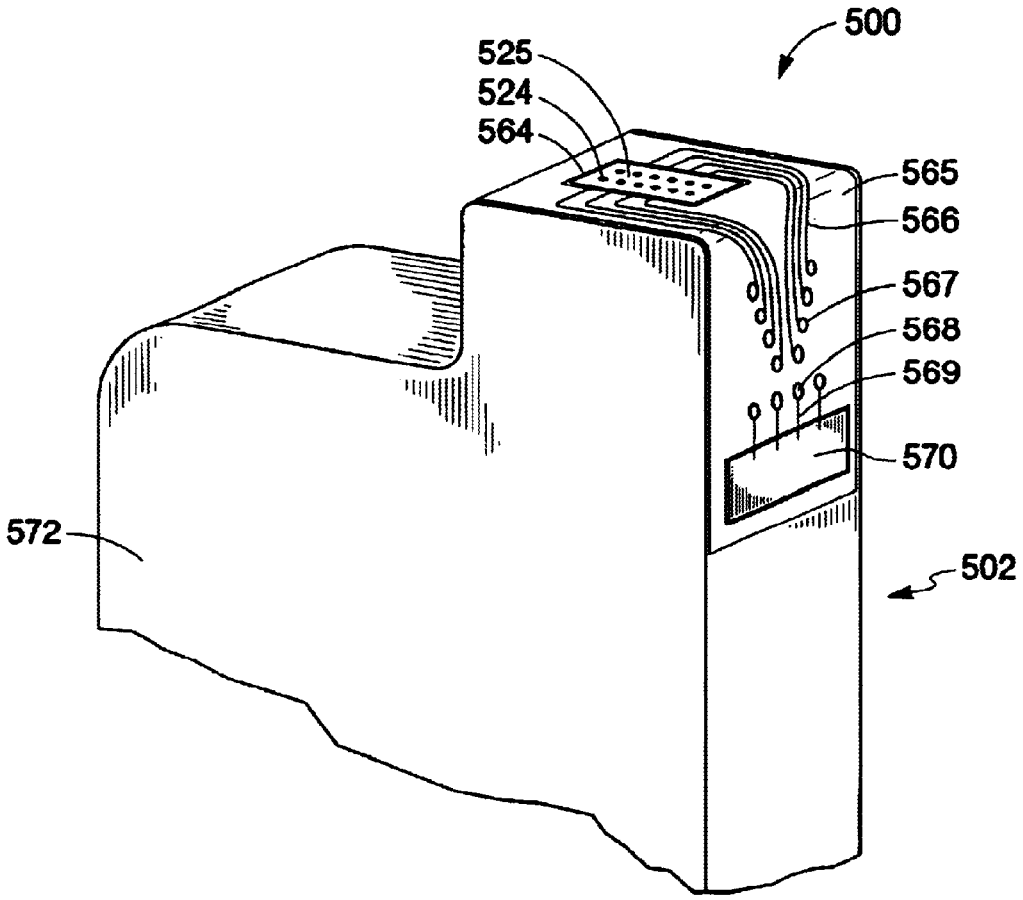
FIG. 5 is a perspective view of a fluid ejection cartridge according to an embodiment of the present invention.

Referring to FIG. 5, an exemplary embodiment of a fluid ejection cartridge 502 of the present invention is shown in a perspective view. In this embodiment, fluid ejection cartridge 502 includes reservoir 572 that contains a fluid, which is supplied to a substrate fluid ejector actuators (not shown) and fluid ejection chamber (not shown). Exit surface 525 of fluid ejector head 500 contains one or more bores or nozzles 524 through which fluid is ejected. Fluid ejector head 500 can be any of the fluid ejector heads described above.

Flexible circuit 565 of the exemplary embodiment is a polymer film and includes electrical traces 566 connected to electrical contacts 567. Electrical traces 566 are routed from electrical contacts 567 to electrical connectors or bond pads on the substrate (not shown) to provide electrical connection for the fluid ejection cartridge 502. Encapsulation beads 564 are dispensed along the edge of exit surface 525 and the edge of the substrate enclosing the end portion of electrical traces 566 and the bond pads on the substrate.

Information storage element 570 is disposed on fluid ejection cartridge 502. In this embodiment information storage element 570 is electrically coupled to flexible circuit 565. Information storage element 570 is any type of memory device suitable for storing and outputting information that may be related to properties or parameters of the fluid or fluid ejector head 500. In this embodiment, information storage element 570 is a memory chip mounted to flexible circuit 565 and electrically coupled through storage electrical traces 569 to storage electrical contacts 568. Alternatively, information storage element 570 can be encapsulated in its own package with corresponding separate electrical traces and contacts. When fluid ejection cartridge 502 is either inserted into or utilized in, a fluid dispensing system, information storage element 570 is electrically coupled to a controller (not shown) that communicates with information storage element 570 to use the information or parameters stored therein.

Figure 6:
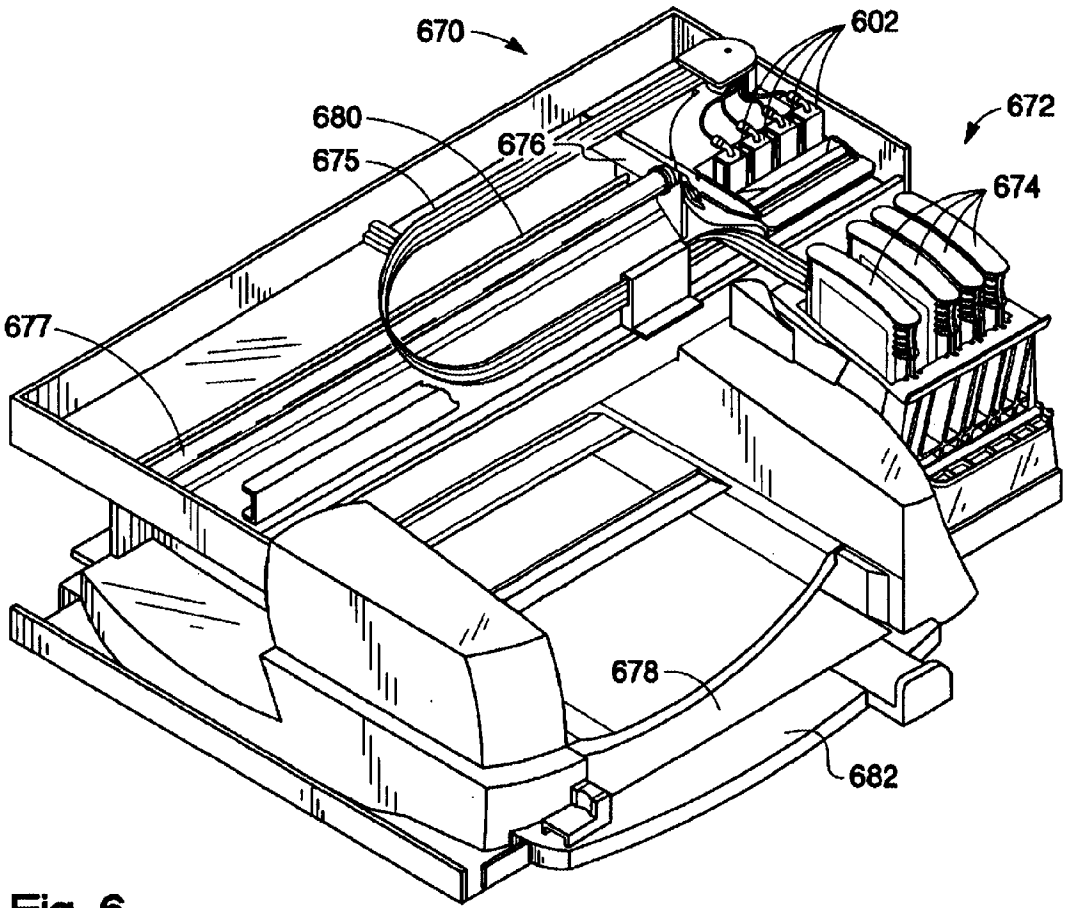
FIG. 6 is a perspective view of a fluid ejection system according to an embodiment of the present invention.

Referring to FIG. 6, a perspective view is shown of an exemplary embodiment of a fluid ejection system of the present invention. As shown fluid ejection system 670 includes fluid or ink supply 672, including one or more secondary fluid or ink reservoirs 674, commonly referred to as fluid or ink cartridges, that provide fluid to one or more fluid ejection cartridges 602. Fluid ejection cartridges 602 are similar to fluid ejection cartridge 502, however, other fluid ejection cartridges may also be utilized. Secondary fluid reservoirs 674 are fluidically coupled to fluid ejection cartridges via flexible conduit 675. Fluid ejection cartridges 602 may be semi-permanently or removably mounted to carriage 676. Fluid ejection cartridges 602 are electrically coupled to a drop firing controller (not shown) and provide the signals for activating the fluid ejector generators on the fluid ejection cartridges. In this embodiment, a platen or sheet advancer (not shown) to which receiving or print medium 678, such as paper or a fluid receiving sheet, is transported by mechanisms that are known in the art. Carriage 676 is typically supported by slide bar 677 or similar mechanism within fluid ejection system 670 and physically propelled along slide bar 677 to allow carriage 676 to be translationally reciprocated or scanned back and forth across sheet 678. Fluid ejection system 670 may also employ coded strip 680, which may be optically detected by a photodetector (not shown) in carriage 676 for precise positioning of the carriage. Carriage 676 may be translated, preferably, using a stepper motor (not shown), however other drive mechanism may also be utilized. In addition, the motor may be connected to carriage 676 by a drive belt, screw drive, or other suitable mechanism.

When a printing operation is initiated, print medium 678 in tray 682 is fed into a fluid ejection area (not shown) of fluid ejection system 680. Once receiving medium 678 is properly positioned, carriage 676 may traverse receiving medium 678 such that one or more fluid ejection cartridges 602 may eject fluid onto receiving medium 678 in the proper position on various portions of receiving medium 678. Receiving medium 678 may then be moved incrementally, so that carriage 676 may again traverse receiving medium 678, allowing the one or more fluid ejection cartridges 602 to eject ink onto a new position or portion that is non-overlapping with the first portion on receiving medium 678. Typically, the drops are ejected to form predetermined dot matrix patterns, forming for example images or alphanumeric characters.

Rasterization of the data can occur in a host computer such as a personal computer or PC (not shown) prior to the rasterized data being sent, along with the system control commands, to the system, although other system configurations or system architectures for the rasterization of data are possible. This operation is under control of system driver software resident in the system's computer. The system interprets the commands and rasterized data to determine which drop ejectors to fire. Thus, when a swath of fluid deposited onto receiving medium 678 has been completed, receiving medium 678 is moved an appropriate distance, in preparation for the next swath. In this manner a two dimensional array of fluid ejected onto a receiving medium may be obtained. This invention is also applicable to fluid dispensing systems employing alternative means of imparting relative motion between the fluid ejection cartridges and the receiving medium, such as those that have fixed fluid ejection cartridges and move the receiving medium in one or more directions, and those that have fixed receiving media and move the fluid ejection cartridges in one or more directions.

While the present invention has been particularly shown and described with reference to the foregoing preferred and alternative embodiments, those skilled in the art will understand that many variations may be made therein without departing from the spirit and scope of the invention as defined in the following claims. This description of the invention should be understood to include all novel and non-obvious combinations of elements described herein, and claims may be presented in this or a later application to any novel and non-obvious combination of these elements. The foregoing embodiments are illustrative, and no single feature or element is essential to all possible combinations that may be claimed in this or a later application.

What is claimed is:

1. A method of manufacturing a fluid ejector head comprising:

forming a chamber in a fluid definition layer, said fluid definition layer having a substantially planar passivation surface;

filling said chamber with a sacrificial material;

planarizing said sacrificial material to the plane formed by said passivation surface;

forming a passivation layer, having substantially planar opposed major surfaces, on said substantially planar passivation surface of said fluid definition layer; and removing said sacrificial layer within said fluid definition layer.

2. The method in accordance with claim 1, further comprising forming a resistive layer, having substantially planar opposed major surfaces, in thermal contact with at least a portion of said passivation layer.

3. The method in accordance with claim 2, further comprising forming an electrically conductive layer electrically coupled to said resistive layer.

4. The method in accordance with claim 3, further comprising:

defining at least one electrical trace in said electrically conductive layer; and etching said electrically conductive layer to form at least one fluid ejector resistor, wherein said at least one electrical trace electrically couples to said at least one fluid ejector resistor.

5. The method in accordance with claim 4, further comprising:

forming a substrate insulating layer over said at least one electrical trace, said passivation layer, and said resistive layer;

planarizing said substrate insulating layer; and creating a substrate over said substrate insulating layer.

6. The method in accordance with claim 5, wherein creating said substrate further comprises anodically bonding a silicon wafer to said substrate insulating layer.

7. The method in accordance with claim 1, wherein forming said chamber further comprises forming a separation interface between said fluid definition layer and a support.

8. The method in accordance with claim 7 wherein said separation interface includes a sacrificial layer.

9. The method in accordance with claim 1, wherein forming said chamber further comprises forming said fluid definition layer by ion implantation in a silicon wafer, wherein a cleavable surface is created.

10. The method in accordance with claim 9, further comprising cleaving said cleavable surface.

11. The method in accordance with claim 1, wherein removing the sacrificial material further comprises selectively etching said sacrificial material.

12. The method in accordance with claim 1, further comprising forming at least one fluid inlet channel extending from said passivation surface of said fluid definition layer to a substrate, wherein said at least one fluid inlet channel is fluidically coupled to said chamber.

13. The method in accordance with claim 1, wherein planarizing said sacrificial material further comprises plananzing said sacrificial material by chemical mechanical polishing.

14. The method in accordance with claim 1, further comprising creating a substrate disposed over said passivation layer.

15. The method in accordance with claim 14, wherein creating said substrate further comprises forming a thermal dissipation layer on a backside of said substrate.

16. The method in accordance with claim 1, wherein forming said chamber further comprises forming said chamber electrochemically or by micromolding.

17. The method in accordance with claim 1, wherein forming said chamber further comprises forming a bore.

18. The method in accordance with claim 17, wherein forming said bore further comprises forming said bore electrochemically or by micromolding.

19. The method in accordance with claim 1, wherein forming said chamber further comprises forming said chamber by dry or wet etching.

20. The method in accordance with claim 1, wherein forming said chamber further comprises:

forming said chamber in a chamber layer; and forming a bore in a bore layer.

21. The method in accordance with claim 1, wherein forming said passivation layer further comprises:

forming a first dielectric layer;

forming a second dielectric layer in contact with said first dielectric layer; and forming a cavitation layer in contact with said first dielectric layer.

22. The method in accordance with claim 21, wherein said first dielectric layer includes silicon carbide, said second dielectric layer includes silicon nitride, and said cavitation layer includes tantalum.

23. The method in accordance with claim 1, wherein forming said passivation layer further comprises:

forming a first dielectric layer disposed on said substantially planar passivation surface;

forming a second dielectric layer disposed on said first dielectric layer; and forming a cavitation layer in contact with said second dielectric layer.

24. A method of manufacturing a fluid ejector head, comprising:

forming a chamber and a bore in a fluid definition layer, said fluid definition layer having a substantially planar passivation surface, wherein said bore extends from a chamber surface to an exit surface, said exit surface opposed to said substantially planar passivation surface;

filling said chamber with a sacrificial material;

planarizing said sacrificial material to the plane formed by said passivation surface, wherein said planarized sacrificial material forms a chamber passivation surface;

forming a passivation layer, having substantially planar opposed major surfaces, on said substantially planar passivation surface of said fluid definition layer and on said chamber passivation surface;

removing said sacrificial layer within said chamber.

25. A method of manufacturing a fluid ejector head, comprising:

forming a chamber in a fluid definition layer, said fluid definition layer having a substantially planar passivation surface;

filling said chamber with a sacrificial material;

planarizing said sacrificial material to the plane formed by said passivation surface;

forming a passivation layer, having substantially planar opposed major surfaces, on said substantially planar passivation surface of said fluid definition layer;

forming a resistive layer, having substantially planar opposed major surfaces on said passivation layer; and forming an electrically conductive layer on at least a portion of said resistive layer.

26. A method of manufacturing a fluid ejector head, comprising:

forming a chamber in a fluid definition layer, said chamber substantially open to a first major surface of said fluid definition layer;

filling said chamber with a sacrificial material;

planarizing said sacrificial material to the plane formed by said first major surface;

forming a cavitation layer, having substantially planar opposed major surfaces, on said first major surface of said fluid definition layer;

forming a first dielectric layer on said cavitation layer;

forming a second dielectric layer on said first dielectric layer;

forming a resistive layer having substantially planar opposed major surfaces on said second dielectric layer; and removing said sacrificial layer within said chamber.

* * * * *